US007827942B2

(12) United States Patent
Hisatomi

(10) Patent No.: US 7,827,942 B2
(45) Date of Patent: Nov. 9, 2010

(54) LUBRICATION STRUCTURE FOR ENGINE

(75) Inventor: Kenji Hisatomi, Hino (JP)

(73) Assignee: Hino Motors, Ltd., Hino-shi (JP)

( * ) Notice: Subject to any disclaimer, the term of this patent is extended or adjusted under 35 U.S.C. 154(b) by 0 days.

(21) Appl. No.: 12/093,238

(22) PCT Filed: Nov. 29, 2006

(86) PCT No.: PCT/JP2006/323798

§ 371 (c)(1),
(2), (4) Date: May 9, 2008

(87) PCT Pub. No.: WO2007/063889

PCT Pub. Date: Jun. 7, 2007

(65) Prior Publication Data

US 2009/0235895 A1 Sep. 24, 2009

(30) Foreign Application Priority Data

Nov. 29, 2005 (JP) ..... 2005-343805

(51) Int. Cl.
*F01P 1/04* (2006.01)

(52) U.S. Cl. ..... 123/41.35; 123/41.34

(58) Field of Classification Search ..... 123/41.34, 123/41.35

See application file for complete search history.

(56) References Cited

FOREIGN PATENT DOCUMENTS

| | | |
|---|---|---|
| EP | 0 154 939 | 9/1985 |
| JP | 2 27144 | 2/1990 |
| JP | 2 56840 | 4/1990 |
| JP | 4 105935 | 9/1992 |
| JP | 6 101473 | 4/1994 |
| JP | 8 177485 | 7/1996 |
| JP | 2002 48001 | 2/2002 |

*Primary Examiner*—Noah Kamen
(74) *Attorney, Agent, or Firm*—Oblon, Spivak, McClelland, Maier & Neustadt, L.L.P.

(57) ABSTRACT

Disclosed is a lubrication structure for an engine comprising pistons 12 for slide motion in cylinders 11 of a V-type engine and lubricating means 13 and 14 for injection of oil to cool the pistons 12.

The lubricating means 13 or 14 being arranged on an anti-thrust load side of each of the cylinders 11 with respect to a sliding surface for the piston 12, a notch of each of the pistons 12 required for said lubricating means 13 and 14 being formed on the anti-thrust load side of the cylinder 11 so as to increase strength of the cylinders 11 and pistons 12.

2 Claims, 2 Drawing Sheets

FIG. 3
PRIOR ART
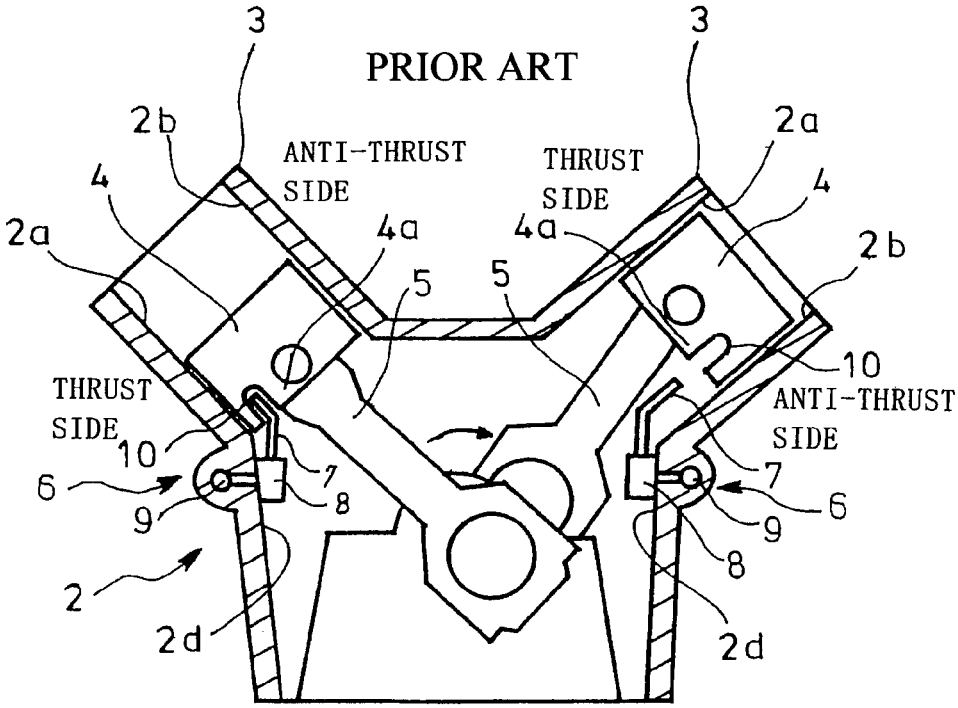
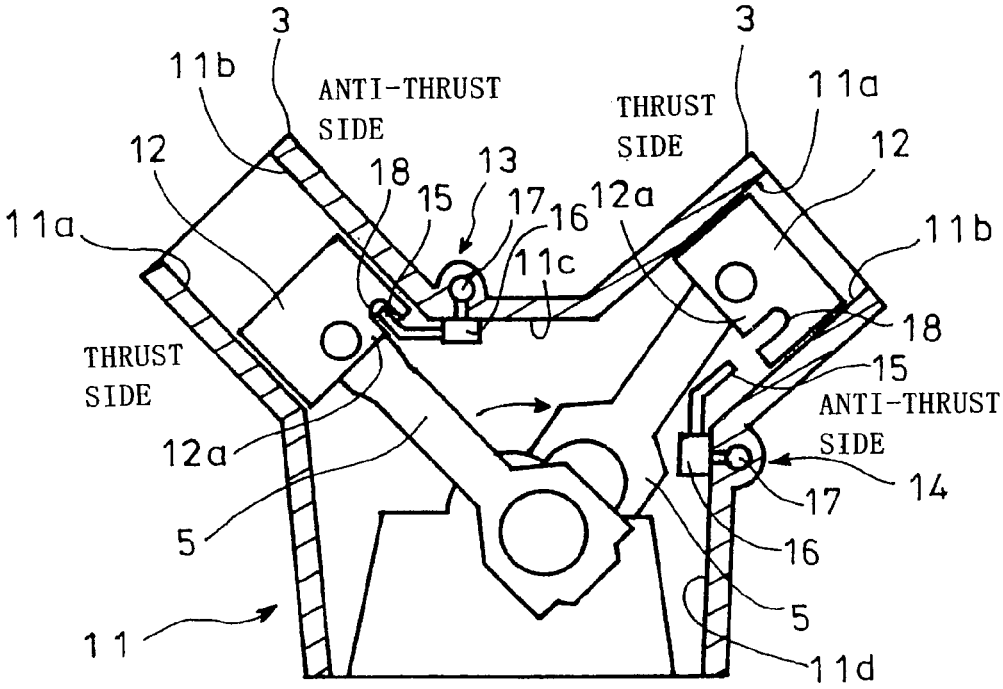
FIG. 4

LUBRICATION STRUCTURE FOR ENGINE

TECHNICAL FIELD

The invention relates to a lubrication structure for an engine.

BACKGROUND ART

As shown in FIGS. 1 and 2, a V-type engine 1 is generally formed with lateral banks 3 for arrangement of a plurality of cylinders 2 laterally oppositely with predetermined angles, each of the cylinders 2 having therein a piston 4 for reciprocating motion, motive energy of the pistons 4 being transmitted through connecting rods 5 to a crankshaft (not shown).

Portions of a sliding surface in the cylinder 2 for the piston 4 which receive more and less lateral pressures by rotation of the crankshaft are referred to as thrust and anti-thrust load side portions 2*a* and 2*b*, respectively. In FIGS. 2 and 3, with the crankshaft being rotated in a clockwise direction, the thrust load side portions 2*a* are lower and upper sides of the left and right cylinders 2, respectively; the anti-thrust load side portions 2*b* are upper and lower sides of the left and right cylinders 2, respectively.

As shown in FIG. 2, provided in the cylinders 2 at upper portions 2*c* between the lateral banks 3 are a plurality of lubricating means 6 for cooling of the pistons 4. Each of the lubricating means 6 comprises, as shown in FIG. 2, a cooling jet 8 with an injection nozzle 7 directed to a skirt 4*a* of the piston 4 and an oil subhole 9 for formation of a flow passage in the upper portions 2*c* of the cylinders 2 so as to supply oil to the cooling jet 8. In a further example of the lubricating means 6 shown in FIG. 3, they are arranged in sides 2*d* of the cylinders 2 and each comprises the cooling jet 8 with the injection nozzle 7 directed to inside of the piston 4 and the oil subhole 9 in the side 2*d* of the cylinder 2 so as to supply oil to the cooling jet 8.

The skirt 4*a* of the piston 4 is formed with a notch 10 for prevention of contact with the injection nozzle 7 of the lubricating means 6 during sliding motion of the piston 4 in the cylinder 2. In the example shown in FIG. 2, the notches 10 are formed adjacent to the upper portions of the cylinders 2 (at upper positions); in the further example shown in FIG. 3, the notches 10 are formed adjacent to the sides of the cylinders 2 (at lower positions).

When the pistons 4 are to be cooled in such lubrication structure, oil is passed via the oil subholes 9 and the cooling jets 8 and is injected by the injection nozzles 7 into the pistons 4.

Conventional art as engine lubricating means is disclosed, for example, in the below-mentioned References 1 and 2.

[Reference 1] Japanese utility model laid-open publication No. 2-27144

[Reference 2] JP 6-101473 A

SUMMARY OF THE INVENTION

Problems to be Solved by the Invention

However, formation of the lubricating means 6 and the notches of the pistons 4 decreases strength of the cylinders 2 and pistons 4, so that it has been desired to increase the strength of the cylinders 2 and pistons 4. Moreover, in the V-type engine 1, the opposing banks 3 are dissymmetric as to the notches 10 of the pistons 4, so that different kinds of pistons 4 are required, which leads to increase in production cost.

The invention was made in view of the above and has its object to provide a lubrication structure for an engine which can enhance strength of the cylinders and pistons.

Means or Measures for Solving the Problems

The invention is directed to a lubrication structure for an engine comprising pistons for slide motion in cylinders of a V-type engine and lubricating means for injecting oil to cool the pistons, said lubricating means being arranged on an anti-thrust load side of each of the cylinders with respect to a sliding surface for the piston, a notch of each of the pistons required for said lubricating means being formed on the anti-thrust load side of the cylinder.

Each of the lubricating means may comprise a cooling jet for injecting oil to the piston and an oil subhole for supplying the oil to said cooling jet.

Thus, according to the invention, for and in each of the cylinders, the lubricating means is arranged, not on the thrust load side which receives more lateral pressure due to slide motion of the piston and is lower in strength, but on the anti-thrust load side which receives less lateral pressure and is higher in strength, whereby the cylinder is prevented from being lowered in strength and the strength of the overall cylinder can be enhanced to improve the reliability of the cylinder. The notch of the piston is not on the thrust load side which receives more lateral pressure, but on the anti-thrust load side which receives less lateral pressure, whereby the portion of the piston which receives more lateral pressure is prevented from being lowered in strength and the strength of the overall piston can be enhanced to improve the reliability of the piston. Upon arrangement of the plural pistons on opposing lateral banks of the V-type engine, the same kind of pistons can be used each with the notch arranged on the anti-thrust load side, so that production cost can be lowered.

When each of the lubricating means comprises a cooling jet for injection of oil to the piston and an oil subhole for supply of the oil to the cooling jet, the oil subhole and the cooling jet are favorably on the anti-thrust load side, so that the lowering in strength of the cylinder can be readily suppressed and the strength of the overall cylinder can be properly enhanced to improve the reliability of the cylinder.

Effect of the Invention

The invention mentioned in the above has the excellent effect or advantage that the strength of the cylinders and pistons can be enhanced since the lubricating means and the notches of the pistons are on the anti-thrust load sides.

BRIEF DESCRIPTION OF THE DRAWINGS

FIG. 3 is a schematic view showing a further example of conventional lubrication structure for an engine; and FIG. 4 is a schematic view showing an embodiment of a lubrication structure for an engine according to the invention.

EXPLANATION OF THE REFERENCE NUMERALS

Figure 1:
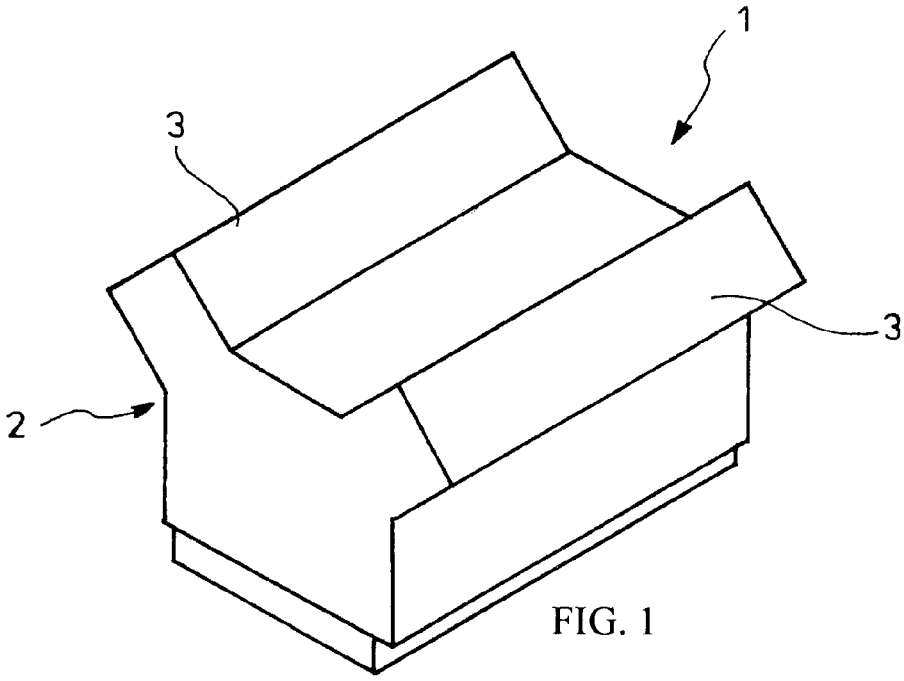
FIG. 1 PRIOR ART
FIG. 1 is a schematic view showing a contour of a V-type engine.

1 V-type engine
11 cylinder
12 piston
13 first lubricating means
14 second lubricating means

16 cooling jet
17 oil subhole

Best Mode for Carrying Out the Invention

An embodiment of the invention will be described in conjunction with the drawing.

Figure 2:
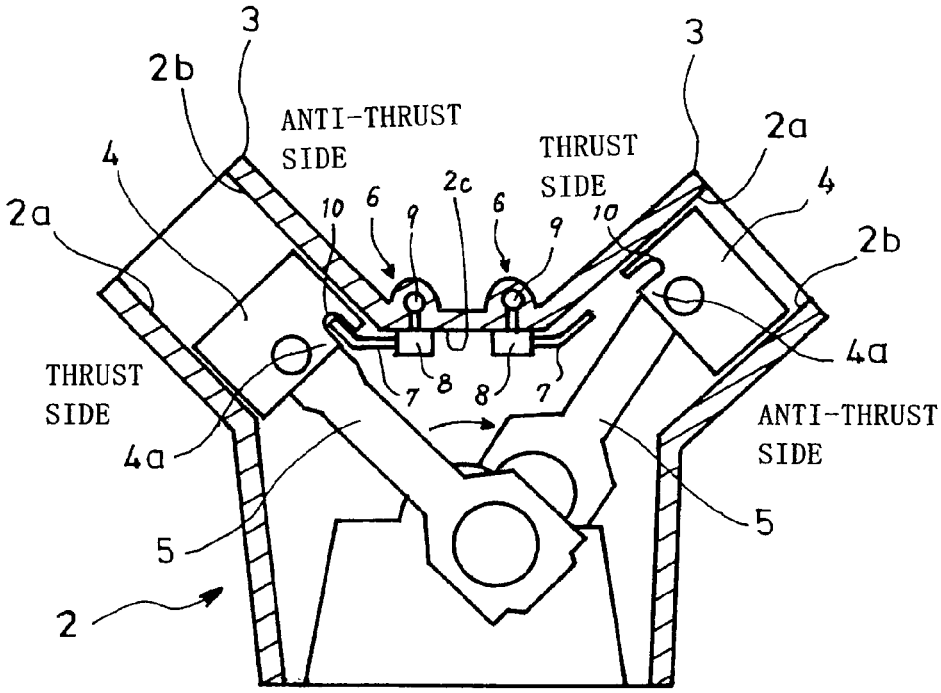
FIG. 2 PRIOR ART
FIG. 2 is a schematic view showing an example of conventional lubrication structure for an engine.

FIG. 4 shows the embodiment of the invention in which parts identical with those in FIGS. 2 and 3 are designated by the same reference numerals.

In the embodiment of the invention, portions of a sliding surface in a cylinder 11 of a V-type engine 1 which receives more and less lateral pressures of a piston 12 by rotation of the crankshaft (not shown) are referred to as thrust and anti-thrust load side portions 11*a* and 11*b*, respectively. In FIG. 4, with the crankshaft being rotated in a clockwise direction, the thrust load side portions 11*a* are lower and upper sides of the left and right cylinders 11, respectively. The ant-thrust load side portions 11*b* are upper and lower sides of the left and right cylinders 11, respectively.

In the cylinders 11, in accord with the laterally opposite pistons of the V-type engine 1, first lubricating means 13 are arranged in upper portions 11*c* as anti-thrust load sides, and second lubricating means 14 are arranged in the sides 11*d* as the anti-thrust load sides, each of the first and second lubricating means 13 and 14 comprising a cooling jet 16 with an injection nozzle 15 directed to inside of the piston 12 and an oil subhole 17 for formation of a flow passage in the cylinder 11 so as to supply oil to the cooling jet 16. In the embodiment of FIG. 4, the first lubricating means 13 to the left piston is arranged in the upper portion 11*c* of the cylinder 11 as the anti-thrust load side, the second lubricating means to the right piston 12 being arranged in the side lid of the cylinder 11 as the anti-thrust load side. Each of skirts 12 of the pistons 12 is formed with a notch 18 at the anti-thrust load side of the cylinder 11 for prevention of contact with the injection nozzle 15 of the lubricating means 13 or 14 upon sliding motion of the piston 12 in the cylinder 11, the pistons 12 in the left and right banks 3 being of the same kind. In the embodiment of FIG. 4, the notch 18 on the skirt 12*a* of the left piston 12 is adjacent to the upper portion of the cylinders 11 (at upper position) so as to accord with the injection nozzle 15 of the first lubricating means 13, the notch 18 of the skirt 12*a* of the right piston 12 being adjacent to the side of the cylinder 11 so as to accord with the injection nozzle 15 of the second lubricating means 14.

Next, mode of operation of the embodiment according to the invention will be described.

When the pistons 12 are to be cooled, oil is passed through the oil subholes 17 and the cooling jets 16 of the first and second lubricating means 13 and 14 and is injected by the injection nozzles 15 into the pistons 12.

Thus, according to the embodiment, for and in the cylinders 11, the first and second lubricating means 13 and 14 are arranged not in the thrust load side portions 11*a* which receive more lateral pressure due to slide motion of the pistons 12 and are lower in strength, but on the anti-thrust load side portions 11*b* which receive less lateral pressures and are higher in strength, whereby the cylinders 11 are prevented from being lowered in strength and the strength of the overall cylinders 11 can be enhanced to improve reliability of the cylinders 11. The notches 18 of the pistons 12 are not on the thrust load sides which receive more lateral pressures, but on the anti-thrust load sides which receive less lateral pressures, whereby the portions of the pistons 12 which receive more lateral pressures are prevented from being lowered in strength and the strength of the pistons 12 can be enhanced to improve the reliability of the pistons 12. Upon arrangement of the plural pistons 12 on the opposing lateral banks 3 of the V-type engine 1, the same kind of pistons 12 can be used each with the notch 18 arranged on the anti-thrust load side, so that production cast can be lowered.

When each of the first and second lubricating means 13 and 14 comprises a cooling jet 16 for injection of oil to the piston 12 and an oil subhole 17 for supply of the oil to the cooling jet 16, oil subhole 17 and the cooling jet 16 are favorably on the anti-thrust load side, so that lowering in strength of the cylinder 11 can be readily suppressed and the strength of the overall cylinder 11 can be properly enhanced to improve the reliability of the cylinder 11.

It is to be understood that a lubrication structure for an engine according to the invention is not limited to the above embodiment and that various changes and modifications may be made without leaving the spirit of the invention. For example, the V-type engine may be any of, for example, six, eight, ten and twelve cylinder engines.

INDUSTRIAL APPLICABILITY

A lubrication structure for an engine according to the invention is applicable to various kinds of engines.

The invention claimed is:

1. A lubrication structure for an engine comprising pistons for sliding motion in cylinders of a V-type engine and lubricating means for injecting oil to cool the pistons, said lubricating means being arranged on an anti-thrust load side of each of the cylinders with respect to a sliding surface for the piston, a notch of each of the pistons required for said lubricating means being formed on the anti-thrust load side of the cylinder.

2. A lubrication structure for an engine as claimed in claim 1, wherein each of said lubricating means comprises a cooling jet for injecting oil to the piston an oil subhole for supplying the oil to said cooling jet.

* * * * *